US006391181B1

(12) United States Patent
Gorodetski et al.

(10) Patent No.: US 6,391,181 B1
(45) Date of Patent: May 21, 2002

(54) ARTICLES HAVING A COLORED METALLIC COATING AND PROCESS FOR THEIR MANUFACTURE

(75) Inventors: Larisa Gorodetski, Hadera; Leonid Levinson, Haifa, both of (IL)

(73) Assignee: Nickel Rainbow Limited, Yaune (IL)

( * ) Notice: Subject to any disclaimer, the term of this patent is extended or adjusted under 35 U.S.C. 154(b) by 0 days.

(21) Appl. No.: 09/180,714

(22) PCT Filed: May 15, 1997

(86) PCT No.: PCT/IL97/00158

§ 371 Date: Aug. 31, 1999

§ 102(e) Date: Aug. 31, 1999

(87) PCT Pub. No.: WO97/43127

PCT Pub. Date: Nov. 20, 1997

(30) Foreign Application Priority Data

May 15, 1996 (IL) ..... 118281

(51) Int. Cl.[7] ..... C25D 5/12; B32B 15/00

(52) U.S. Cl. ..... 205/181; 205/164; 205/183; 205/184; 205/187; 205/215; 205/216; 205/246; 205/255; 205/271; 205/291; 205/317; 427/409; 428/626; 428/637; 428/675; 428/679; 428/658; 428/680; 428/926; 428/935; 428/927

(58) Field of Search ..... 428/622, 626, 428/637, 671, 375, 676, 678, 679, 681, 658, 680, 926, 935, 927, 457; 427/409; 205/182, 183, 184, 187, 215, 216, 240, 246, 255, 271, 291, 317, 50, 164, 167, 176, 181

(56) References Cited

U.S. PATENT DOCUMENTS 2,844,530 A * 7/1958 Wesley et al. ..... 205/181
5,023,146 A * 6/1991 Saito et al. ..... 428/626

FOREIGN PATENT DOCUMENTS

JP 6-184790 5/1994

* cited by examiner

*Primary Examiner*—Robert R. Koehler
(74) *Attorney, Agent, or Firm*—Lilling & Lilling P.C.

(57) ABSTRACT

An article includes a colored electroplated metallic coating comprising both nickel and zinc, on an underplate of copper, brass, bright nickel or matt nickel, supported on a metallic or plastic substrate, various colors in the electroplated coating being exemplified. The electrolyte contains $Ni^{2+}$, $Zn^{2+}$, $(NH_4)^+$ and thiocyanate ions in specified concentrations, but no oxidative ion, color variation of the coating being achieved exclusively by variation of current density, time of the electroplating step and current quantity, provided that the current density at the cathode underplate is within the range of 0.01 to 0.5 A/dm$^2$.

14 Claims, 1 Drawing Sheet

ARTICLES HAVING A COLORED METALLIC COATING AND PROCESS FOR THEIR MANUFACTURE

FIELD OF THE INVENTION

The present invention relates to a technique for producing colored electroplated nickel coatings and to articles producible by this technique.

BACKGROUND OF THE INVENTION

The electrodeposition of nickel on metal substrates such as steel, copper and brass, is widely used in industry in order to meet both decorative and protective requirements for a wide range of goods. The properties provided by an electrodeposited nickel surface, for engineering applications, are generally adhesion, and corrosion- and wear-resistance, hardness and ductility, while for consumer applications the same qualities are relevant, and additionally the appearance of the surface becomes of great importance as part of the decorative value of the products.

The appearance of an electrodeposited nickel coating is usually described in terms of properties such as brightness, reflectivity, tarnish resistance, smoothness, texture and so forth. For esthetic reasons, the color of the coating is also of importance, especially for consumer applications, but the possibilities for imparting intrinsic color to electrodeposited nickel are very limited.

While aluminum may be provided with an oxide film coating which imparts excellent corrosion- and wear-resistance, by an electrolytic process in which aluminum constitutes the anode—"anodizing"—and while such a coating may be successfully colored, such a technique is not applicable to nickel.

In painting technology, it is known to provide surfaces with pigmented polymeric coatings, in order to obtain articles with a colored finish, but of course the surface is not metallic, and thus cannot for example be selected to be a mirror, matt, full-bright or semi-bright finish. Moreover, the manufacturing process then requires an additional coating-pigmenting step, which it would be desirable to avoid, if this were possible.

It is also known to provide colored metallic finishes on (usually bright) electrodeposited nickel with a restricted range of colors. Thus, various hues and shades of gold can be deposited in this manner from gold cyanide electrolyte, and silver can be plated from cyanide electrolyte from a dissolving silver anode. Similarly, a dark gray-blue finish can be imparted to nickel by electrodeposited ruthenium. Such metallic finishes suffer from the following drawbacks:

(a) the color range is limited to golds, silvers and gray-blues;
(b) the high price of the coloring component makes such processes expensive, and in case stripping is required this would also be expensive;
(c) plating from cyanide electrolytes is neither user-friendly nor environment-friendly;
(d) each color requires its own special electrolyte, so that the plating bath must be changed in order to change the color.

In an attempt to meet in particular the limitation of the narrow range of obtainable colors, a number of formulations have been developed for coloring metal surfaces electrolytically or by dipping. By way of example, a solution of lead acetate, sodium thiosulfate and acetic acid can produce a blue color on electrodeposited nickel; a solution of potassium chlorate, and copper and nickel sulfates can produce brown colors on brass and copper; and a solution of copper sulfate containing acetic acid and glycerol, in addition to ammonium, sodium and zinc chlorides, produces the so-called tiffany green on brass or nickel, by repeated immersion and drying of the articles in question. Production of such single colors is unlikely to be economical, and it should also be noted that similarly to the previously-mentioned overplating techniques using gold, silver or ruthenium, these colors each require particular process conditions and often exotic electrolytes or dipping solutions, so that the plating conditions and the bath must be changed in order to change the color, which features of course add to the difficulties of carrying out operations which are commercially viable. An additional problem in such cases is that the obtainable colors and hues are sensitive to slight changes in plating parameters, so that the results may depend more on the operator's skill, than on a particular formulation and plating conditions.

Another approach to solving the problem of the lack of variety of colors available by simply overplating nickel, has been the electrophoretic technique, which involves the deposition of pigment particles in the micronic size range from a pigment suspension in an electroplating bath. Although this technique does provide a variety of colors in the articles thus produced, at the same time the finishes lack the brilliance of nickel-plated articles and are tarnish-like, semi-bright colors. As we have seen in various known techniques, here too, each color requires its special coloring bath, and changing the color means changing the bath. Moreover, stripping of the color is not practical, so that if the finished article is defective in color or appearance, the defect cannot be repaired.

Although not answering consumer demand for a variety of colors, electrodeposition on a metal cathode of a black coating known as "black oxide" or "black nickel", is also commercially available, and affords a range from light gray to black anthracite. Black nickel is usually plated onto a brass or nickel base, or onto steel provided with an intermediate layer of zinc, copper or nickel. A variety of electroplating conditions and electrolyte formulations for such purposes have been described in the art, but the formulations virtually all contain zinc, nickel and sulfur, in thiosulfate. These formulations, generally termed "oxidizing liquid" are available in the market, in concentrated liquid form. According to U.S. Pat. Nos. 4,861,441 and 5,011,744, black nickel coatings of excellent quality are said to be obtainable in presence of a strongly oxidizing anion, and cations of Zn and a "coloring metal" i.e. Fe, Co, Ni, Cr, Sn or Cu, at a pH of 1–4, a current density of 5–100 A/dm$^2$ and a current quantity of 20–200 coulombs/dm$^2$. Somewhat similar are processes for obtaining a black electrodeposited coating, described in U.S. Pat. Nos. 4,968,391 and 5,023,146, in which the bath contains additionally a sulfur compound such as a thiocyanate or a thiosulfate, and the preferred current density is 1–50 A/dm$^2$. Also described in the literature is a process for obtaining black nickel electroplated coatings from a bath containing Ni, Zn and ammonium cations and thiocyanate anions, at a pH of from 3.5 to 6.0, and a cathode current density of 0.15–0.2 A/dm$^2$ (Dennis, J. K. & Such T. E., Nickel and Chromium Plating, 2nd Edition, Butterworth, 1986, see also U.S. Pat. No. 2,844,530).

A phenomenon related to the problem of providing electrodeposited colored metallic surfaces is that of light interference in submicronic/micronic electroplated films, in which the color depends on film thickness. For example, cuprous oxide changes its color from an initial violet through blue, green, yellow, orange and red, due to the interference phenomenon, as the film thickness increases (see e.g. Solomon, H., Isserlis, G. and Averil, A. F., "Protective and Decorative Coatings for Metals", Finishing Publications Ltd., USA, 1978). However, this phenomenon is not commercially viable because of the unreliability of the desired color, since the slightest changes in electroplating parameters or physical variation in the metal surface, leads to an even more dramatic change, in color or hue, of the electroplated film.

The entire contents of the above-mentioned patents and literature references are incorporated by reference herein. Briefly summarized, the need for a viable process for obtaining the unique and vivid beauty of mirror-like full-bright nickel coated metal surfaces in a variety of colors has not been satisfied by techniques known in the art.

OBJECTS OF THE INVENTION

A primary object of the invention is to provide a colored electroplated coating on bright or matt nickel as underplate, and a process for the preparation thereof.

Another object of the invention is to provide a colored electroplated coating, and a process for the preparation thereof as just recited, wherein the color of the coating can be varied and can be predetermined by selecting process parameters.

Still another object of the invention is to provide a colored electroplated coating as aforesaid, and a process for the preparation thereof, wherein the coating has a lustrous brilliant appearance similar to a high level conventional bright or matt electroplated nickel coating.

Yet another object of the invention is to provide a colored electroplated coating as aforesaid, and a process for the preparation thereof, wherein the ingredients of the electrolytes used are neither more expensive nor more hazardous than those used conventionally for nickel electroplating.

Yet a further object of the invention is to provide a colored electroplated coating as aforesaid, and a process for the preparation thereof, wherein the coloring process is stable, in that acceptable variation of colors can be assured by corresponding variation within a reliable range of process parameters.

Another very important object of the invention is to provide a colored electroplated coating as aforesaid, and a process for the preparation thereof, wherein various colors and hues of the colored coating can be produced using the same bath and the same electrolyte solution, by selecting the process parameters exclusively.

Other objects of the invention will be apparent from the description which follows.

SUMMARY OF THE INVENTION

In one aspect, the present invention provides an article including a colored electroplated metallic coating comprising both nickel and zinc, on bright or matt nickel as underplate, wherein variation of the color of the electroplated coating does not depend on variation of the identity of the cations in the electrolyte from which said coating is electrolytically deposited. This aspect of the invention as claimed herein is subject to a proviso that more than 65% of the colors in said coating are other than black and that the colors in said coating are not selected exclusively from the group consisting of black and white.

More particularly, in the article of the invention, the color of the electroplated colored coating has been preselected exclusively by variation of parameters in the electroplating step selected from current density, time of the electroplating step and current quantity, subject to the condition that a current density applied to the article as cathode was within the range of 0.01 to 0.5, preferably 0.02 to 0.2 A/dm$^2$.

In another aspect, the invention provides a process for manufacturing an article with a colored metallic coating comprising both nickel and zinc, which process includes the step of electroplating said coating on bright or matt nickel as underplate, in an electrolyte bath at a pH in the range of 4.5 to 5.5 and at a temperature within the range of 15 to 35° C., containing as cations $Ni^{2+}$, $Zn^{2+}$ and $(NH_4)^+$, and (SCN)_ (thiocyanate) anions, wherein the color of the electroplated coating is preselected exclusively by variation of parameters selected from current density, time of the electroplating step and current quantity, subject to the condition that a current density is applied to said underplate as cathode within the range of 0.01 to 0.5, preferably 0.02 to 0.2 A/dm$^2$.

For the purpose of the present specification and claims, the "color" of the electroplated coating has its ordinary dictionary meaning, excluding 100% black and/or white; thus, articles having wholly black and/or white electrodeposited coatings on a nickel underplate, and processes for manufacturing them, are excluded from the scope of the present invention. However, articles including mixtures of colors in the coating, and processes for manufacturing them, are included in the invention. In accordance with a preferred embodiment of the invention, more than 65% of the color or colors in the colored coating (e.g. according to the color analysis of the Pantone Guide) is/are other than black. Thus, in the examples (infra), which are of course only illustrative and do not limit the invention, in round figures, 66, 73, 80, 86, 89, 90, 93 or 100% of the color(s) in the colored coating are other than black when analyzed according to the Pantone Guide.

The terms "electroplated", "electroplating" and similar terms have their normal meaning in the art and thus exclude, for example, other electrical processes such as electrophoresis.

From what has been stated above, the term "variation of parameters" as used herein in relation to the process of the invention, or in relation to the process by which the article of the invention may be obtained, refers in particular to variation of current density, time of the electroplating step and current quantity (which of course are interrelated); such variation permits the obtainment of coatings of preselected colors. On the other hand, it is a particular and distinctive feature of the present invention that different colored coatings are obtained while maintaining the identity of the chemical ingredients in the electroplating bath. Thus, according to the invention, selection of the color of the coating is not determined by adding or subtracting ingredients in the electroplating step. The electroplating step is also preferably carried out within prescribed ranges of pH and temperature.

It will accordingly be apparent that the present invention is distinct from the prior art in which gold and silver cyanides can provide, respectively, only gold and silver coatings; where the presence of ruthenium in the bath will give only blue-gray coatings; from so-called "colored" coatings which are in practice limited to black nickel coatings; from a combination of bath ingredients which gives only the so-called "tiffany green" colored coating, from a different combination of ingredients which gives only a blue coating and from yet a different combination which gives only a brown coating. Moreover, the present invention achieves for the first time commercially viable electrodeposited nickel coatings of predetermined selected colors with the intrinsic advantages pertaining to nickel. While the present invention is not considered to be limited by any theory, it is believed that the variation in colors of the electrodeposited colored coating containing nickel is connected with the phenomenon of light interference; presuming this to be so, then the invention for the first time attains colors in electrodeposited nickel coatings making use of the phenomenon of light interference, according to which the color of the coating is related to its thickness. Moreover, the present invention makes possible for the first time commercially viable articles having lustrous metallic coatings, the color of which apparently depends on the phenomenon of light interference, in which the color is stable.

DETAILED DESCRIPTION OF THE INVENTION

Figure 1:
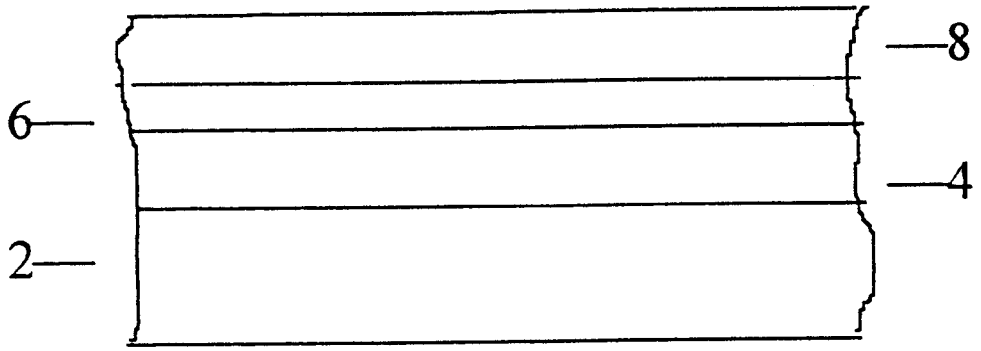
FIG. 1 is a schematic representation of a section through the periphery of an article according to an embodiment of the invention, or manufactured according to an embodiment of the process of the invention.

In FIG. 1, which is a schematic representation of a section through the periphery of an article according to an embodiment of the invention, or manufactured according to an embodiment of the process of the invention, reference numeral 2 represents a metallic substrate layer overplated with nickel layer 4, which is otherwise referred to throughout the specification and claims as "underplate" because it constitutes a basis for the electrodeposited colored layer 6. Layer 6 may be protected by guard layer 8.

As has been mentioned above, in the electroplating step according to the invention the nickel underplate is used as cathode. The anode can be made of any suitable conductive but substantially insoluble material, e.g., stainless steel. Apart from the particular parameters mentioned herein, the electroplating step can be carried out in any suitable conventional electroplating apparatus using for example conventional racks, although presently preferred are racks made of titanium. In operating the present invention, best results in relation to satisfactory adhesion of the colored coating and its brilliance, may be obtained if the underplate is of high purity and uniform thickness, and if the underplate has itself a brilliant lustrous bright or matt finish. Thus, it is preferred to coat the underplate on a suitable substrate by a conventional electrolytic or electroless method and then substantially immediately afterwards electrolytically deposit the colored coating on this fresh underplate. When not using a freshly deposited underplate, then in accordance with another preferred embodiment of the invention, prior to electrodeposition of the coating comprising both nickel and zinc, the underplate is pretreated in order to ensure substantial absence from the underplate of oxide film, absorbed gases and organic matter, such as grease.

In accordance with another preferred embodiment of the invention, the underplate has a thickness of at least five microns. Where the underplate is less than five microns in thickness, this may lead to an undesirable influence of the substrate on the appearance of the colored coating, besides which stripping of such an ultra-thin nickel underplate may sometimes occur. It will be appreciated that the nickel underplate will be supported on a substrate, for example a metallic substrate, e.g. of nickel, steel, copper or brass.

In accordance with an embodiment of the invention, the colored coating has a thickness within the range of 0.05–2 microns. In the process of the invention, the electroplating step may of course be terminated, for example, when the coating has a thickness within the range of 0.05–2 microns, or when it has a desired preselected color, or both. After completion of the electroplating step, the article is removed from the bath, and it is then normally washed with water and dried. In accordance with a particular embodiment, the colored coating is thereafter provided with a transparent colorless protective film of thickness in the range of from submicronic to 30 microns (preferably 1 to 30 microns), e.g. by lacquering. The thus-prepared products meet all relevant ASTM requirements for indoor applications.

The colors of the colored coatings in the article of the invention, or provided by the process of the invention, may have various hues. As thickness of the colored coating increases, the colors are formed in a particular order, and when the cycle is repeated, the colors are generally formed again in the same order. The colored coating includes a mixture of nickel and zinc, together with their oxides and sulfides.

Insofar as the composition of the electrolyte plating bath is concerned, it is preferred that the stated ingredients are present within the following ranges of concentrations (g/l): $Ni^{2+}$8–15 (preferably 8–11); $Zn^{2+}$1.5–8; $(NH_4)^+$3–5.5; $(SCN)^-$9–20. Particularly preferred are concentrations (g/l) within the following ranges: $Ni^{2+}$10–11; $Zn^{2+}$5–7; $(NH_4)^+$ 4.5–5; $(SCN)^-$15–20. It may be noted that within the above-stated preferred range of concentration of ingredients, the Zn:Ni ratio is not greater than 1:1. Additionally, it is especially preferred that the Zn:Ni ratio is not smaller than 0.1:1. More generally, the effect of working outside the prescribed or preferred parameter limits is summarized in the following table:

| CHANGE IN PARAMETER | UNDESIRABLE EFFECTS |
|---|---|
| Zn:Ni ratio > 1:1 | color selection uncontrolled, blackening |
| Zn:Ni ratio < 0.1:1 | colors lack luster, indefinite color-to-color transition, colors becoming gray or black |
| $Ni^{2+}$ | |
| <8 g/l | unstable indefinite colors |
| >15 g/l | precipitation of salts, general deterioration of the process |
| $Zn^{2+}$ | |
| <1.5 g/l | uncertain, disappearing colors |
| >8 g/l | unstable colors, blackening, precipitation of salts, general deterioration of the process |
| $(SCN)^-$ <9 g/l | color tends to disappear |
| $(NH_4)^+$ <3 g/l, pH <4.5 | acidification, hydrogen generation at cathode |
| $(NH_4)^+$ >5.5 g/l, pH >5.5 | precipitants in cathode area |
| temperature <15° C. | precipitation of salts |
| temperature >35° C. | blackening of coating |
| current density (A/dm$^2$) <0.01 | slow process, dull colors |
| current density (A/dm$^2$) >0.5 | process uncontrollable |

As has been stated above, the color of the electroplated coating is preselected exclusively by variation of parameters selected from current density, time of the electroplating step and current quantity, subject to the condition that a current density is applied to said underplate as cathode within the range of 0.01 to 0.5, preferably 0.02 to 0.2 A/dm$^2$; this statement is intended to convey that while the identities of the ingredients of electrolyte bath are constant and the invention is normally operated within the stated parameters of pH and temperature, for the purpose of selecting the color of the colored electrodeposited coating, variation is effected only in respect of current density, time and current quantity. In this context, while the operative and preferred ranges of current density have already been mentioned, the preferred operative current quantity falls within the range of 5–20 coulombs/$dm^2$, particularly 8–15 coulombs/$dm^2$. Within these current quantity ranges, various colors and hues of the colored coating can be obtained.

In accordance with a particular embodiment of the invention, it is preferred to operate the electroplating step which affords the colored coating in accordance with the invention, within the ranges of the stated conditions and at the same time within certain tolerances of variation, in order to obtain stable colors in the colored coating. "Stable" in this context means that there will be <10% variation in the "E-factor" (ASTM D2244-93). These tolerances may be expressed as follows:

| PARAMETER | VARIATION TOLERANCE |
|---|---|
| concentrations (g/l) of | |
| $Ni^{2+}$ | 1 |
| $Zn^{2+}$ | 0.5 |
| $(NH_4)^+$ | 0.25 |
| $(SCN)^-$ | 2 |
| current density (A/$dm^2$) | 0.005 |
| time (seconds) | 30 |
| current quantity (coulombs/$dm^2$) | 0.15 |
| pH | 0.1 |
| temperature (° C.) | 5 |

The invention will now be illustrated by the following non-limiting Examples, in which the cited color numbers and their percentage composition are those of the "Pantone Color Formula Guide 1000" (1995 edition), Pantone Inc., 590 Commerce Boulevard Carlstadt, N.J. 07072-3098, USA; all coating colors are bright colors and the description of the overall color in each case, while subjective, is derived from the chromaticity diagram in CIE publication 15.2, ASTM E 308 and DIN 5033. Examples 1–9 illustrate that aspect of the invention in which more than 65% of the colors in the coating are other than black; it may be noted that in these Examples, the current quantity utilized in each case falls within the range of 5.4 to 57.6 coulombs/$dm^2$.

EXAMPLE 1

An electrolyte bath of 10 l. volume, equipped with a titanium rack and a stainless steel (insoluble) anode, contained as electrolyte a solution of the following composition: $NiSO_4.6H_2O$ 47.3, $ZnSO_4.7H_2O$ 24.7, $(NH_4)_2SO_4$ 16.8 and KSCN 27.2 g/l. The (ambient) temperature of the bath was 18° C. and it had a pH value of 5.1. The articles to be colored by electrodeposition according to the invention were stainless steel plates, employed as cathode, having dimensions 128×40×1.5 mm, which had been precoated with a bright nickel electrodeposited coating of about 20 microns thickness. Immediately before applying the colored coating, the plates were activated by polishing with a slurry of fine MgO and CaO (1:1); rinsing with deionized water while ensuring unbroken coverage of the metal surface (indicating absence of organic matter); dipping in aqueous ≈10% HCl; and again rinsing with deionized water. The electrodeposition of the colored coating was carried out for 2 minutes at current density 0.05 A/$dm^2$ while the bath was subjected to gentle magnetic stirring. At the end of this period, the plates, which had a bright blue coating, were removed from the bath, rinsed with water and dried. This color was identified with No. 66.5-5405 and contained 31.8% blue, 4.6% yellow, 13.6% black and 50% white.

EXAMPLE 2

By proceeding as described in Example 1, but carrying out electrodeposition of the colored coating for 4 minutes instead of 2 minutes, the plates had a bright coating which was a light yellow in color. This color was identified with No. 75-619 and contained 40% yellow, 10% black and 50% white.

EXAMPLE 3

By proceeding as described in Example 1, but carrying out electrodeposition of the colored coating for 8 minutes instead of 2 minutes the plates had a bright greenish-yellow coating, the color being identified with No. 41-370 and containing 23.5% red, 70.6% green and 5.9% blue.

EXAMPLE 4

By proceeding as described in Example 1, but carrying out electrodeposition of the colored coating for 14 minutes instead of 2 minutes, the plates had a bright coating which was a deep bordeaux red in color. This color was identified with No. 85-690 of the Pantone Guide and contained 72.7% red and 27.3% black. By stopping the process at 10 minutes instead of 14 minutes, the purple-red color of the coating could be identified with No. 22-242 and contained 65% red, 20% black and 15% purple.

EXAMPLE 5

By proceeding as described in Example 1, but carrying out electrodeposition of the colored coating for 12 minutes instead of 2 minutes, the plates had a bright yellowish-green coating which was identified with No. 39-357 and contained 65% green, 15% yellow and 20% black.

EXAMPLE 6

By proceeding as described in Example 1, but carrying out electrodeposition of the colored coating for 3 minutes instead of 2 minutes, and by using different values for current density as indicated below, the plates developed a bright coating having the following respective colors:

| | | % | | | | | color |
|---|---|---|---|---|---|---|---|
| A/$dm^2$ | color no. | red | blue | yellow | black | white | (subjective) |
| 0.03 | 10–161 | 20 | | 60 | 20 | | yellowish-orange |
| 0.05 | 69.5–5635 | | 4.5 | 4.5 | 3.4 | 87.6 | bluish-green |
| 0.08 | 137–1807 | 94.1 | 5.9 | | | | red |
| 0.12 | 66.5–5405 | | 31.8 | 4.6 | 13.6 | 50 | blue |

EXAMPLE 7

An electrolyte bath of 100 l. volume, equipped with a titanium and a stainless steel (insoluble) anode, contained as electrolyte a on of the following composition: $NiSO_4.6H_2O$ 44.5, $ZnSO_4.7H_2O$ 25.2, $(NH_4)_2SO_4$ 16.8 and KSCN 33.1 g/l. The temperature of the bath was 26° C. and it had a pH value of 4.8. The articles to be colored by electrodeposition according to the invention were stainless steel tubes, employed as cathode, having dimensions 75×42 (diameter)×2 mm, which had been precoated on the outer surface with a bright nickel electrodeposited coating of about 20 microns thickness. Before applying the colored coating, the plates were activated as described in Example 1. The electrodeposition of the colored coating was carried out for various time periods at current density 0.06 A/dm$^2$ under gentle air stirring, and the tubes were removed from the bath, rinsed with water and dried. The results are shown below:

| | | % | | | | | | color |
|---|---|---|---|---|---|---|---|---|
| time (mins) | color no. | red | green | blue | yel-low | black | white | (sub-jective) |
| 4 | 67.7–5487 | | | 11 | 7 | 7 | 75 | greenish-blue |
| 6 | 53.5–4505 | | | 1 | 17 | 7 | 75 | orange-pink |
| 8 | 20–229 | 73 | | | | 27 | | purple-pink |
| 10 | 33.5–3165 | | 28 | 61 | | 11 | | blue-green |
| 12 | 52.2-warm gray 11 | 2 | | | | 20 | 78 | — |

EXAMPLE 8

By proceeding as described in Example 7, but carrying out electrodeposition of the colored coating for a constant time of 4 minutes while using different values for current density as indicated below, the outer surface of the tubes developed a bright coating having the following respective colors:

| | | % | | | | | | color |
|---|---|---|---|---|---|---|---|---|
| A/dm$^2$ | color no. | red | blue | yel-low | black | white | pur-ple | (sub-jective) |
| 0.06 | 67.7–5487 | | 11 | 7 | 7 | 75 | | greenish-blue |
| 0.07 | 665–5405 | | 31.8 | 4.6 | 13.6 | 50 | | blue |
| 0.10 | 22.5–2425 | 55.6 | | | 11.1 | | 33.3 | red-purple |

EXAMPLE 9

By proceeding as described in Example 7, but carrying out electrodeposition of the colored coating for 8 minutes while using a current density of 0.12 as indicated below, the outer surface of the tubes developed a predominantly bright blue-violet coating which was identified with No. 27.5-2765 and contained 22% blue, 11% black and 67% violet.

Application of the Guard Film

In a particular embodiment of the invention, a transparent colorless protective film ("guard film") having a thickness of submicronic to 30 microns may be applied over the colored coating. This may be effected by any suitable method known in the art, e.g. a solution of transparent film-forming material in an appropriate solvent is applied as by spraying or dipping the colored electroplated article, after which the solvent is allowed to evaporate. By way of non-limiting illustration only, the products of any of Examples 1–9 were coated with guard film of thickness in the range 10–15 microns by conventional spraying thereon under an air pressure of 2–3 atm., of "lacquer 300–610" (Tambour Ltd., Akko, Israel), comprising a polyimide ester diluted with a liquid hydrocarbon mixture "H-300" (Tambour), the amount of diluent being adjusted, e.g., until the viscosity of the lacquer was 17–20 secs. (time of emptying a 100 ml viscometer through a 4 mm hole), the solution being passed through a filter (e.g. having 20–25 micron holes) before use; and allowing the solvent to evaporate in a clean, dust-free environment for 24–36 hours at ambient temperature. Oven-drying at 140–150° C. for 20–30 minutes, or a combination of oven- and ambient-drying, may alternatively be used The thus-coated products were tested as indicated in paragraph (2), below.

Properties of the Colored Coating (1) In absence of the Guard Film.

(a) Samples were subjected to the heat quench test (ASTM B571-91). After heating at 250° C. and quenching in water, there were no blisters and no flaking or peeling of the colored coating, thus indicating satisfactory adhesion.

(b) The average composition and the thickness of the colored coating were determined according to the Auger method (see Ronald F. Weber, "Auger Electron Spectroscopy for Thin Film Analysis", Physical Electronics Industries, Inc., Edina, Minn., USA); results are shown in the following Table:

| Product of | Main | Atomic Composition (%) | | | | Thickness |
|---|---|---|---|---|---|---|
| Example | Color | Ni | Zn | O | S | (microns) |
| 1 | blue | 14.0 | 37.4 | 22.0 | 18.7 | 0.065 |
| 2 | yellow | 14.5 | 37.4 | 22.0 | 18.7 | 0.135 |
| 3 | green | 12.6 | 37.4 | 22.1 | 18.7 | 0.338 |

(2) In presence of the guard film.

(a) Samples showed no change after exposure to UV light for 7 days according to ASTM D4587-91.

(b) Samples showed no change after being subjected to a salt spray chamber for 7 days according to ASTM B117-94, thus showing satisfactory corrosion resistance.

(c) Samples showed satisfactory adhesion after being subjected to the test of ASTM D3359-93.

While particular embodiments of the invention have been particularly described hereinabove, it will be appreciated that the present invention is not limited thereto, since as will be readily apparent to skilled persons, many modifications or variations can be made. Such modifications or variations which have not been detailed herein are deemed to be obvious equivalents of the present invention.

In one such modification, in place of the mentioned bright or matt nickel underplate, there may be used, for example, brass or copper as underplate. In another such modification or variation, whereas in a particular embodiment the underplate is supported on a metallic substrate, there may alternatively be used a plastic substrate, e.g. of polyvinyl chloride, polymethylmethacrylate or acrylonitrile-butadiene-styrene terpolymer (ABS),.

As stated herein, the colored coating in the present invention excludes by definition 100% black and/or white, and in a particular embodiment more than 65% of the colors in the coating may be other than black. However, in a further useful embodiment of the invention, there is provided a process which is capable of producing coatings not only 65–100% black, but additionally those in which black may constitute a significant proportion, e.g. 35–90%, of the coating (10–30% other colors), 70–90% black being preferred. When 70–90% of the colored coating is black (10–65% other colors but not 10–65% white), the colored coating is a "warm black" when the 10–30% other color(s) is/are yellow and/or red, but "cold black" when the 10–30% other color(s) is/are blue and/or green. In this process for manufacturing an article including a colored metallic coating comprising both nickel and zinc, said coating is formed by electrolytic deposition from an electrolyte, said electrolytic deposition defining an electroplating step, on an underplate selected from copper, brass, bright nickel and matt nickel, said underplate being supported on substrates selected from the group consisting of metallic and plastic substrates, wherein variation of color of said coating comprising nickel does not depend on variation of identity of cations in said electrolyte, and provided that said color is not selected exclusively from the group consisting of black, white and mixtures thereof; which process includes the step of electroplating said coating on said underplate, in an electrolyte bath at a pH in the range of 4.5 to 5.5 containing as cations $Ni^{2+}$, $Zn^{2+}$ and $(NH^4)^+$, and thiocyanate anions, wherein the color of the electroplated coating is preselected exclusively by variation of parameters selected from current density, time of the electroplating step and current quantity, subject to conditions that the current density is applied to said underplate as cathode within the range of 0.01 to 0.5 $A/dm^2$ and that the stated ingredients are present in the electrolyte bath within the following ranges of concentrations, namely, $Ni^{2+}$8–11; $Zn^{2+}$1.5–8; $(NH^4)^+$3–5.5; $(SCN)^-$9–20 g/l.

It should be emphasized that to obtain viable significantly black colors does not involve a different selection of the electrolyte ions from those used to obtain other colored coatings in accordance with the invention. What is involved is rather a change in the process parameters, in particular use of a somewhat higher operating temperature, e.g. within the range of 35 to 45° C.

In the process just described, it is preferred to apply increasing current densities within the stated range. We have found, for example, that by applying an initial current density within the range of 50–150 $mA/dm^2$, for (say) 3–5 minutes, followed immediately—without changing any other parameters—by a current density within the range of 300–400 $mA/dm^2$, for a similar period of (say) 3–5 minutes, there may be obtained a "warm black" coating having superior adhesion characteristics (contrasted with prior art black nickel coatings which frequently have poor adhesion). These specified conditions are of course merely illustrative and are not to be regarded as limiting; a person of average skill in the art could readily devise variations of these conditions in order to obtain electrolytic coatings, of the type with which this aspect the present invention is concerned, having superior adhesion characteristics. Such variations could, for example, include predetermination of the time for electrolytic plating to obtain the desired result, including predetermined times for applying consecutively relatively lower and higher current densities, in order to obtain an aesthetically pleasing coating having also excellent adhesion characteristics. This aspect of the invention will be illustrated by the following Example.

EXAMPLE 10

An electrolyte bath of 100 l. volume, equipped with a titanium rack and a stainless steel (insoluble) anode, contained as electrolyte a solution of the following composition: $NiSO_4.6H_2O$ 44.5, $ZnSO_4.7H_2O$ 25.2, $(NH_4)_2SO_4$ 16.8 and KSCN 33.1 g/l. The temperature of the bath was 40° C. and it had a pH value of 4.8. The articles to be colored by electrodeposition according to the invention were employed as cathode, being plastic tubes fabricated from acrylonitrile-butadiene-styrene terpolymer (ABS), having dimensions 75×42 (diameter)×2 mm, which had just been precoated on the outer surface with a bright nickel electrodeposited coating of about 10 microns thickness. The electrodeposition of the colored coating was carried out under gentle air stirring, initially for 4 minutes at current density 0.1 $A/dm^2$, and immediately afterwards in the same bath, for 4 minutes at current density 0.34 $A/dm^2$. The tubes were removed from the bath, rinsed with water and dried. The "warm black" (80% black, 20% red) coating, Pantone No. 426 when analyzed according to the Auger method (see (b), above), was found to have an average % composition Ni 25.2, Zn 33.1, O 20.1 and S 16.8, and a thickness of about 2 microns, and it had superior adhesion characteristics when tested according to ASTM D3359-93.

What is claimed is:

1. A process for manufacturing an article with a colored metallic coating comprising both nickel and zinc, which process includes a step of electroplating on bright or matt nickel as underplate, in absence of oxidative ion, in an electrolyte bath at a pH in the range of 4.5 to 5.5 and at a temperature within the range of 15 to 35° C., containing as cations $Ni^{2+}$, $Zn^{2+}$ and $(NH_4)^+$, and thiocyanate anions, within the following ranges of concentrations, namely, $Ni^{2+}$ 8–11; $Zn^{2+}$1.5–8; $(NH_4)^+$3–5.5; $(SCN)^-$9–20 g/l, wherein the color of the thus-formed electroplated coating is formed exclusively by variation of parameters selected from the group consisting of current density applied to said underplate as cathode, time of the electroplating step and current quantity, subject to a condition that the current density is within the range of 0.01 to 0.5 $A/dm^2$.

2. Process according to claim 1, wherein said underplate has been deposited on a substrate immediately before electrodeposition of said colored coating or alternatively said underplate has been pretreated in order to ensure substantial absence therefrom of oxide film, absorbed gases and organic matter.

3. Process according to claim 1, wherein said underplate has a thickness of at least five microns.

4. Process according to claim 1, wherein said underplate is supported on a metallic substrate.

5. Process according to claim 4, wherein said metallic substrate is selected from the group consisting of nickel, steel, copper and brass.

6. Process according to claim 1, wherein the electroplating step is terminated when the colored coating has a thickness within the range of 0.05–2 microns.

7. Process according to claim 1, wherein the electroplating step is terminated when the colored coating has a desired color.

8. Process according to claim 1, which includes the additional step of providing the colored coating with a transparent protective film of thickness in the range of from submicronic to 30 microns.

9. A process for manufacturing an article including a colored coating having a metallic content which consists essentially of nickel and zinc, which coating has been formed by electrolytic deposition from an electrolyte containing nickel, zinc ammonium and thiocyanate ions, said electrolytic deposition defining an electroplating step, on an underplate selected from the group consisting of copper, brass, bright nickel and matt nickel, said underplate being supported on a substrate selected from the group consisting of metallic and plastic substrates;

which process includes the step of electroplating said coating on said underplate, in absence of oxidative ion, in an electrolyte bath at a pH in the range of 4.5 to 5.5, containing as cations $Ni^{2+}$, $Zn^{2+}$ and $(NH_4)^+$, and thiocyanate anions, wherein the color of the electroplated coating is formed exclusively by variation of parameters selected from the group consisting of current density, time of the electroplating step and current quantity, subject to conditions that the current density is applied to said underplate as cathode within the range of 0.01 to 0.5 $A/dm^2$ and that the stated ingredients are present in the electrolyte bath within the following ranges of concentrations, namely, $Ni^{2+}$8–11; $Zn^{2+}$ 1.5–8; $(NH_4)^+$3–5.5; $(SCN)^-$9–20 g/l.

10. A process according to claim 9, wherein said colored coating comprises 35–90% black, 10–65% other colors, provided that the colored coating is not 35–90% black, 10–65% white.

11. A process according to claim 10, wherein said colored coating comprises 70–90% black, 10–30% other colors.

12. A process according to claim 11, wherein said colored coating is selected from the group consisting of warm black and cold black, and wherein warm black comprises 70–90% black, 10–30% of at least one color selected from the group consisting of yellow and red, and cold black comprises 70–90% black, 10–30% of at least one color selected from the group consisting of blue and green.

13. A process according to claim 9, wherein there are applied increasing current densities within said current density range.

14. A process according to claim 13, wherein there is applied an initial current density within the range of 50–150 $mA/dm^2$, followed immediately by a final current density within the range of 300–400 $mA/dm^2$.

* * * * *